United States Patent [19]

Martin

[11] 4,002,103

[45] Jan. 11, 1977

[54] RECIPROCATING APPARATUS WITH A CONTROLLABLE DWELL TIME AT EACH END OF THE STROKE

[75] Inventor: Frederick W. Martin, Pottstown, Pa.

[73] Assignee: The West Company, Phoenixville, Pa.

[22] Filed: July 1, 1974

[21] Appl. No.: 484,699

[52] U.S. Cl. ..... 91/219; 91/308; 91/318; 91/323; 91/350; 91/471

[51] Int. Cl.[2] ..... F01L 31/00

[58] Field of Search ..... 91/1, 219, 304, 305, 91/308, 323, 465, 280, 350, 318; 92/5 R

[56] References Cited

UNITED STATES PATENTS

| | | | |
|---|---|---|---|
| 2,302,232 | 11/1942 | MacNeil | 91/318 |
| 2,698,517 | 1/1955 | Witt | 91/318 |
| 2,934,899 | 5/1960 | Koplin et al. | 91/304 X |
| 3,160,486 | 12/1964 | Busch, Jr. | 91/219 X |
| 3,260,164 | 7/1966 | Guentner et al. | 91/465 X |
| 3,470,692 | 10/1969 | Kamp | 91/465 X |
| 3,516,763 | 6/1970 | Manton | 91/318 |
| 3,625,622 | 12/1971 | Wright | 91/3 |
| 3,635,125 | 1/1972 | Rosen et al. | 91/323 X |
| 3,648,568 | 3/1972 | Wright | 92/5 R |
| 3,682,042 | 8/1972 | Bain | 91/308 X |
| 3,691,902 | 9/1972 | Lebzelter | 91/1 |
| 3,695,023 | 10/1972 | Hayashi et al. | 91/219 X |
| 3,707,881 | 1/1973 | Neuhaus et al. | 91/308 X |
| 3,720,137 | 3/1973 | Landherr et al. | 91/304 X |
| 3,887,160 | 6/1975 | Cusveller | 91/1 X |
| 3,895,560 | 7/1975 | Anderson | 91/1 |

FOREIGN PATENTS OR APPLICATIONS

| | | | |
|---|---|---|---|
| 379,979 | 9/1932 | United Kingdom | 91/219 |
| 1,222,840 | 2/1971 | United Kingdom | 91/1 |

*Primary Examiner*—Martin P. Schwadron
*Assistant Examiner*—Abraham Hershkovitz
*Attorney, Agent, or Firm*—Howson and Howson

[57] ABSTRACT

The piston of a pneumatic cylinder is reciprocated with a controllable dwell time at each end of its stroke, under the control of a digital fluidic circuit which responds to the termination of exhaust flow at the end of each piston stroke to initiate the reverse piston stroke. The air for driving the piston is supplied alternately to opposite ends of the piston through respective cylinder ports, by way of a corresponding pair of pilot valves which are controlled by the fluidic circuit so that one or the other of the pilot valves may supply driving air to the piston at any time. Whenever the piston is in motion, a stream of exhaust air flows through the exhaust port ahead of the piston, and this exhaust stream acts through the fluidic control circuit to maintain the pilot valves in their then-existing states; when the exhaust stream stops at the end of a piston stroke, the fluidic circuit responds to produce a pneumatic pulse delayed by a controllable time with respect to termination of exhaust flow, and this delayed pulse triggers a two-state fluidic device to its opposite state; this in turn reverses the states of the pilot valves so that the other pilot valve now supplies driving air to the opposite end of the piston to drive it in the opposite direction. Reciprocation can be "turned off" by supplying a simulated exhaust stream to the fluidic circuit. Fluidic outputs indicative of the direction of piston movement and of whether reciprocation is occurring are also provided.

3 Claims, 2 Drawing Figures

14a
12a
18
20
12
14
24
26
50
48
44
46
16
54
56
34
36
32
90
92
88
OFF-ON
DWELL
80
94
96
64
66
74
72
60
68
62
70
FLUIDIC AIR OUTLET
82
97
100
CYLINDER AIR OUTLET
40
84
98
99
84
30
133
CYLINDER AIR INLET
FLUIDIC AIR INLET
LOGIC & CONTROL CIRCUITRY
102

RECIPROCATING APPARATUS WITH A CONTROLLABLE DWELL TIME AT EACH END OF THE STROKE

BACKGROUND OF THE INVENTION

This invention relates to apparatus and method for effecting reciprocation of a piston, and especially to such apparatus for effecting linear reciprocatory motions of a piston with a dwell time at the end of each direction of reciprocation, the dwell time preferably being the same at both ends of the stroke and controllably adjustable.

There are a large number of applications in which it is desirable to produce controlled reciprocation of a piston by means of fluid pressures applied alternately to opposite ends of the piston. In certain cases it is also desired that the piston dwell in one or both of its two end positions, and in some cases that these dwell times be controllably adjustable. Such uses commonly arise, for example, in connection with assembly line production and product handling equipment, wherein the piston is advanced to move an object into a measurement position, remains in that position during the measurement, is retracted to permit the object to be moved out of the measurement station, and remains in the retracted position sufficiently long for the next object to move into position in the measurement station.

One application of such apparatus with respect to which the invention will be particularly described is in the testing of bottle closures. For example, my copending application Ser. No. 475,113, filed May 31, 1974, illustrates a situation in which the thickness of a membrane at the center of a bottle closure is measured by moving the closure against the protruding end of the probe of a fluidic thickness-checking device to check whether this thickness is within or outside of permissible tolerances. In this application, successive stoppers are moved into position against the sensor probe by means of a supporting piston which is first retracted to permit the closure to move into position at the measuring station; is then advanced to move the closure forward into a reference position against the sensor probe; remains or dwells in this position while the measurement is made and the results indicated or used to control automatic reject equipment; and is then retracted and left in its retracted position while the just-tested closure moves out of the measurement station and the next closure moves into position in the station.

It is also desirable in some cases that the reciprocating piston reverse its motion, e.g. change from its advancing stroke to its retracting stroke, whenever the piston motion is arrested, whether or not it has completed its maximum possible stroke.

Accordingly it is an object of the invention to provide a new and useful apparatus and method for effecting reciprocation of a piston.

It is also an object to provide such apparatus and method in which the reciprocation of the piston is provided with a substantial dwell time at least at one end of its stroke.

A further object is to provide such a dwell time at both ends of said stroke.

It is also an object to provide such apparatus and method in which the dwell times at both ends of the stroke are controllably adjustable from a single common control.

It is also an object to provide such a method and apparatus in which the piston motion will automatically reverse itself whenever its motion is arrested, regardless of whether it has completed its maximum stroke.

It is also an object to provide such apparatus which is controlled by fluidic means.

A further object is to provide such method and apparatus which is small, inexpensive, and consistent in its operation.

A further object is to provide such apparatus and method which supplies external fluidic indication of the direction of reciprocation of the piston at any time.

SUMMARY OF THE INVENTION

These and other objects of the invention are realized by a method and apparatus in which means are provided for sensing the exhaust flow from at least one of the exhaust ports beyond the ends of the piston in a cylinder, and the termination of such exhaust flow is utilized to control the timing of the initiation of the reverse stroke of the piston. Preferably the exhaust flows from both ports at the opposite ends of the cylinder are sensed so that only when there is no flow from either of them is the piston direction reversed. Preferably the reversal of piston motion is initiated only following a predetermined delay after termination of exhaust flow, so as to provide a dwell time of the piston in its extreme position.

The desired control of the timing of the alternate application of fluid pressure to opposite ends of the piston is preferably accomplished by a fluidic circuit, the output of which includes a two-state device which in one state causes fluid under pressure to be applied to one end of the piston and in its other state causes fluid under pressure to be applied to the opposite end of the piston; control of the state of the two-state device is preferably accomplished by fluidic means which leaves the two-state device in either one of its existing states so long as there is exhaust flow from at least one of the exhaust ports, but switches the two-state device to its opposite state at a time delayed by a predetermined amount with respect to the time of termination of exhaust flow from both ports. This delay is preferably provided in the fluidic circuit by an appropriate flow restrictor and accumulator combination.

A control for arresting reciprocation of the piston is preferably provided by supplying a simulated exhaust flow into the fluidic circuit, which causes the two-state means to stay in its then existing condition so long as such simulated exhaust flow persists. Preferably also the exhaust flow from each cylinder port causes a fluidic flow from a corresponding outlet from the fluidic circuit as an indication of the direction of motion of the piston at a given time.

BRIEF DESCRIPTION OF FIGURES

These and other objects and features of the invention will be more readily understood from a consideration of the following detailed description, taken in connection with the accompanying drawings, in which.

DETAILED DESCRIPTION OF SPECIFIC EMBODIMENTS

Figure 1:
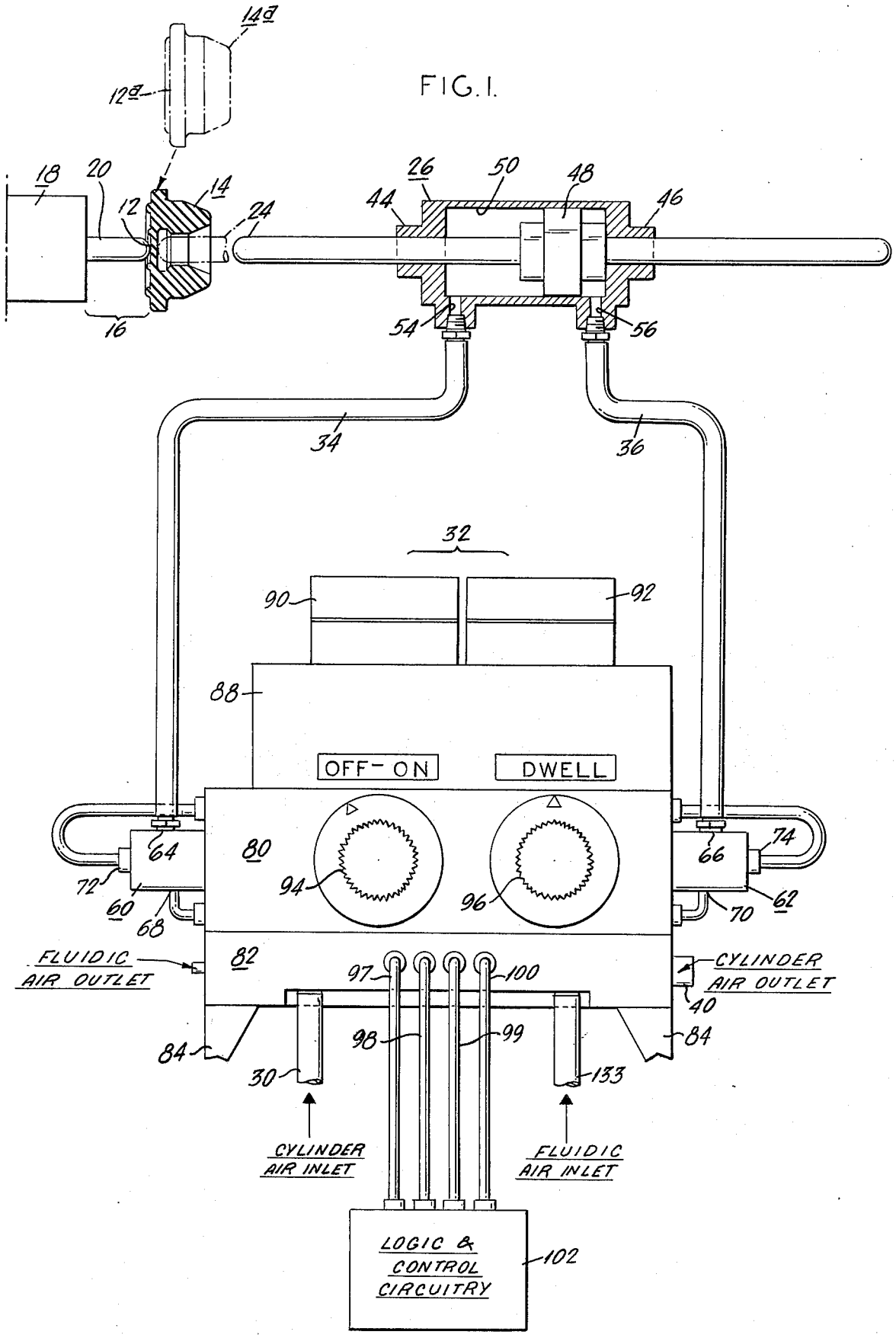
FIG. 1 is a schematic elevational view, partly in section, illustrating an embodiment of the invention in one of its possible applications.

Referring now by way of example only to the embodiment of the invention specifically shown in the drawings, and in which corresponding parts of the two drawings are shown by corresponding numerals, the invention is illustrated in connection with the measurement of the thickness of a membrane such as 12, 12*a*, etc. in a series of plastic bottle closures such as 14, 14*a*, etc. which are moving in a sequential train into and out of a thickness-measuring station 16. The thickness-measuring device may include the thickness sensor 18 of my above-identified copending application, having an outwardly-biased sensor probe 20 for contacting one surface of the membrane, the thickness thereof being indicated by the axial position assumed by the sensor probe 20. The closure 14 is brought up to a predetermined reference position with respect to probe 20 by means of the reciprocating piston 24 of a conventional pneumatic cylinder device 26, the piston having a retracted position as shown in full line to permit the closure to move into axial alignment with the probe and piston, and having an advanced position shown in broken line in which the thickness-measurement is made. During its advance, the piston 24 impales the closure by way of the central opening therein, and advances it to a reference position for which piston 24 is in its maximum forward position.

The remainder of the system, next to be described, controls the position of the piston 24 so that it dwells for a predetermined length of time in its retracted position to permit the closure to move into the station 16, advances to a predetermined extent, remains in its advanced position for a controlled dwell time while the measurement is made by the thickness sensor 18, and then again retracts to permit removal of the measured closure. While the movement of the closure in and out of the measuring station can be accomplished manually, ordinarily it will be provided by means of suitable automatic conveying equipment, now shown because of its conventional nature.

Cylinder air inlet 30 provides a source of cylinder operating air under pressure for driving the piston 24 in its reciprocating motion. Inlet 30 supplies this cylinder air first to the fluidic control and interface unit 32, which operates to supply the pressurized cylinder air alternately to the two cylinder feed lines 34 and 36 at the desired times. Fluidic control and interface unit 32 also provides exhaust for the two cylinder air lines 34 and 36, by internal connection to cylinder air oulet 40.

More particularly, the piston 24 of cylinder device 26 is supported in end bushings 44 and 46 to permit axial reciprocation, and has an enlarged central portion 48 located within the cylinder chamber 50, the stroke of the piston in each direction being limited at each extreme end by abutment of the corresponding end of the enlarged cylinder portion 48 against the corresponding end wall of cylinder chamber 50. Cylinder air ports 54 and 56, to which lines 34 and 36 are connected, communicate with the cylinder chamber beyond the extreme positions of the enlarged portion 48 of the piston 24, so that they are never closed off by the piston. It will thus be seen, for example, that when pressurized cylinder air is supplied to port 54, it will urge the piston toward the right in the retracting direction, as air on the right-hand side of the enlarged piston portion 48 is exhausted through port 56, until the piston is arrested in the maximum retracted position shown in full line in FIG. 1; at this time exhaust flow through port 56 will cease. Similarly, when the pressurized cylinder air is supplied to port 56, it will urge the piston to its advanced position shown in broken line, with exhaust of air occurring through port 54 only while the piston is in the course of advancing to its final arrested position.

In the physical embodiment of the invention illustrated in FIG. 1, the switching of the pressurized cylinder air between lines 34 and 36, and the corresponding switching of these lines to exhaust them to atmosphere, are controlled by a corresponding pair of pilot valves 60 and 62 of conventional, commercial form, having respective cylinder connections 64 and 66, respective exhaust connections 68 and 70, and respective pilot control connections 72 and 74. Each pilot valve is in this example of a type which is normally spring-biased to a position for which its cylinder connection is connected to its exhaust connection, but each responds to a fluidic pilot pressure applied to its pilot control connection to connect its cylinder connection instead to the cylinder air inlet 30. Thus by alternating the application of fluidic pressure to control connections 72 and 74, the desired alternation of the connections of the cylinder ports 54 and 56 to the high pressure supply and to atmospheric exhaust is accomplished.

In the embodiment of FIG. 1, the pilot valves are mounted in an upper metal block 80, which is in turn mounted on a lower metal block 82 supported on legs such as 84. Most of the cylinder air interconnections are formed within the blocks 80 and 82, while most of the fluidic devices and interconnections are formed in a fluidic block 88 of successive laminations provided with appropriate apertures to form the desired passages and devices. A pair of interface amplifiers 90 and 92 are mounted on the fluidic integrated circuit block 88. On the front of block 80 there are provided two manually-rotatable control knobs 94 and 96 by which the operator can adjust, respectively, the off or on condition of reciprocation of the piston in the cylinder device 26, and can adjust the duration of the dwell time of the piston 24 at each end of its stroke.

Figure 2:
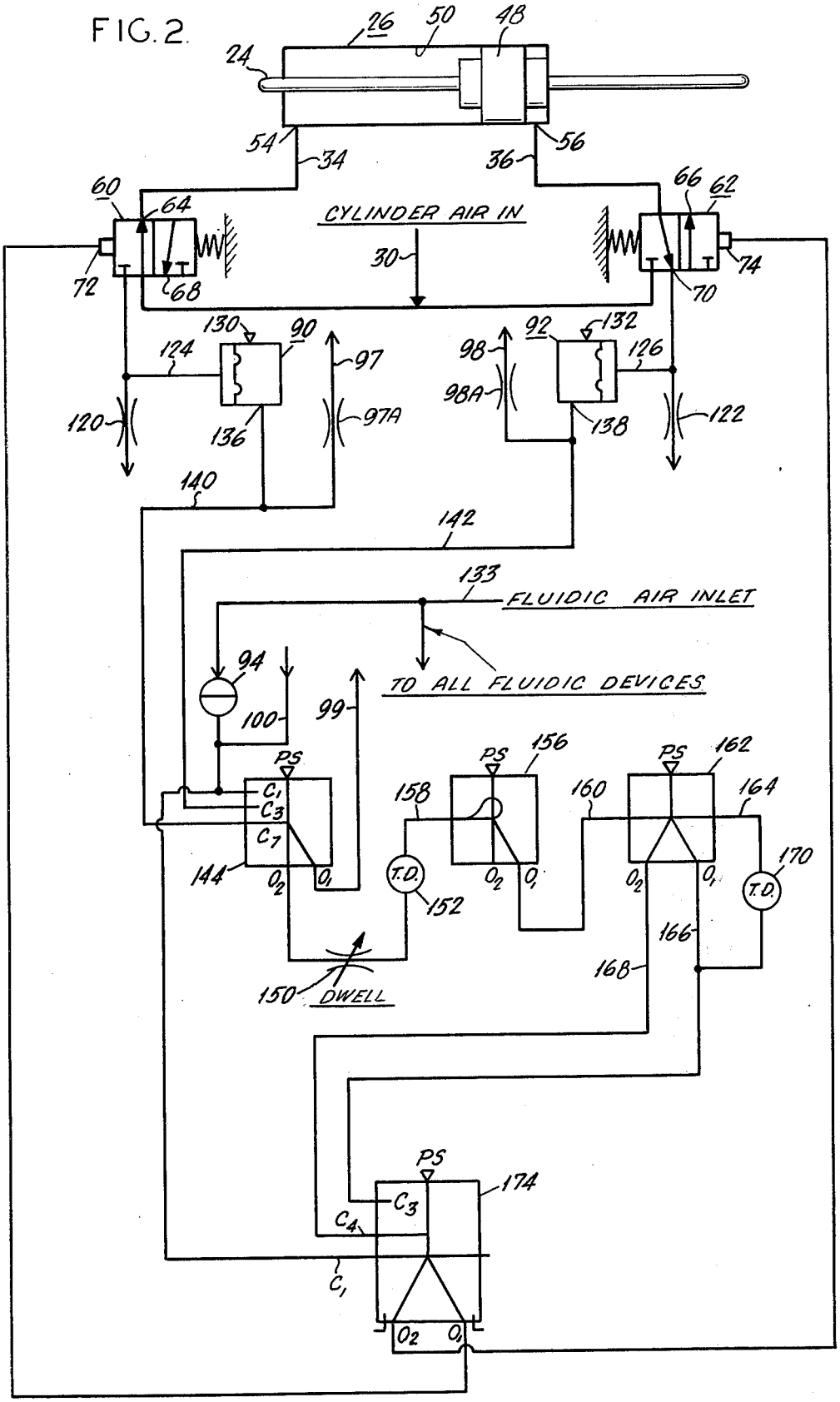
FIG. 2 is a fluidic and pneumatic schematic diagram showing in detail a representative embodiment of the invention.

Four fluidic lines 97, 98, 99 and 100 are connected from the lower block 82 to logic and control circuitry 102. As described more fully in connection with FIG. 2, three of these lines convey to the logic and control circuitry 102 fluidic information as to whether the piston 24 is moving to the left or to the right, and whether the cylinder reciprocation circuitry is turned on; the fourth connection enables remote automatic turning on and off of the cylinder reciprocation. Logic and control circuitry 102 is not shown in detail, since it is not concerned with the essence of the present invention, but it will be understood that it may contain any of a large variety of types of circuitry for controlling such things as timing of the motion of the closures, synchronization with other testing or handling procedures, and electrical storage and transfer of test information so that it remains identified with the particular closure from which that information was obtained, thus for example permitting later downstream rejection of each faulty closure.

Obviously many other forms of physical embodiment, and many other applications, of the invention are possible, the arrangement illustrated in FIG. 1 being shown merely for the purpose of definiteness and example.

Referring now especially to FIG. 2, there is shown again the cylinder device 26, the ports 54 and 56 of which are connected to the pilot valves 60 and 62 by way of the cylinder lines 34 and 36, respectively; each pilot valve is internally spring-biased toward the position in which the ports 64 and 66 are connected to their corresponding exhaust ports 68 and 70. Thus, fluidic pilot pressure applied to either of the pilot connections 72 or 74 results in switching that pilot valve to its driving condition in which the corresponding cylinder line is connected to the cylinder air inlet 30; absence of fluidic pilot pressure causes the corresponding cylinder line to be connected to its exhaust port.

Pilot valve exhaust ports 68 and 70 are both vented to atmosphere by way of respective restrictors 120 and 122, and the pressure developed across the restrictors is applied, respectively, over lines 124 and 126 to the control inputs of the respective isolator amplifiers 90 and 92. The latter may be conventional devices, sometimes known as diaphragm isolators, such as are made by Corning Glass Works of Corning, New York. Devices 90 and 92 are provided with fluidic power supply air at their main jet orifices 130 and 132 respectively, the purified fluidic air for these main jet ports being provided from the fluidic air inlet 133, as is the case for all of the fluidic power supply points in the fluidic circuit. The outlet ports 136 and 138 of devices 90 and 92 are normally isolated from the fluidic jet by the action of an internal diaphragm, but receive substantially the full jet flow when the exhaust flow from cylinder device 26 causes a pressure to be developed at the corresponding input line 124 or 126. Thus when the piston 24 is moving to the left, the pressure in line 124 due to exhaust flow will cause a fluidic flow through outlet port 136, the diaphragm device serving to isolate the relatively pure cylinder air from the highly-purified fluidic air; simiarly, when piston 24 is moving to the right, a fluidic flow will occur through outlet port 138 of device 92. At other times there will be substantially no flow through the outlet ports 136 and 138.

Outlet ports 136 and 138 of devices 90 and 92 are connected to two respective control inputs $C_3$ and $C_7$of a fluidic OR/NOR gate 144 which, like the other fluidic devices presently to be described, may be a conventional digital fluidic device such as are available from Corning Glass Works of Corning, New York. OR/NOR device 144 has the property that if there is no input fluidic stream to any of its control inputs $C_1$, $C_3$, or $C_7$, the main inlet stream will flow to outlet $O_2$; on the other hand, if there is an inlet stream present at any of the control inputs $C_1$, $C_3$ or $C_7$, the main fluidic stream will flow to outlet port $O_1$, but only so long as such input stream continues.

The output of OR/NOR gate 144 at its outlet $O_2$ is supplied through an adjustable restrictor 150 to a time delay accumulator 152 which, when it fills to its outlet port, supplies the control input to the fluidic one shot device 156. The time required for the control input device 156 to occur, after an output first occurs at outlet $O_2$ of device 144, depends upon the product of the rate of flow through the restrictor 150 and the volume of the time delay accumulator 152. In this embodiment, this delay corresponds to the dwell time of the piston 24 at each end of its stroke, and is manually adjustable by the dwell control 96 of FIG. 1. Restrictor 150 may, for example, comprise an adjustable needle valve.

One-shot multivibrator 156 has the property that the fluidic jet therein normally is delivered to its outlet port $O_2$, but when a control input of substantial duration is applied to its input line 158, the jet is switched to its other outlet port $O_1$, remains in this condition for a time determined by the characteristics of device 156, and automatically reverts to outlet $O_2$. This reverting of output from outlet $O_1$ to $O_2$ after a predetermined fixed time occurs even though the control input on line 158 persists.

Recapitulating the operation of the fluidic system thus far described, so long as the piston 24 is moving in either direction there will be an exhaust stream applied to either control input $C_3$ or control input $C_7$ of OR/NOR gate 144, the jet thereof will remain switched to the outlet $O_1$, and the one-shot multivibrator will not be actuated under such conditions. It is also noted that the fluidic air inlet 133 is connected through the off/on valve 94 to the third control input $C_1$ of OR/NOR gate 144. When off/on valve 94 is closed as shown, it does not supply a fluidic stream to control input $C_1$ and hence has no effect on OR/NOR gate 144; however, when valve 94 is opened, a fluidic stream will be supplied to control input $C_1$ to hold the fluidic jet of gate 144 in communication with its outlet port $O_1$. Thus, opening of valve 94 simulates an exhaust stream in preventing fluidic flow to outlet port $O_2$ of gate 144, and, as will become more apparent hereinafter, therefore serves as a means for arresting reciprocation of the piston 24. When off/on valve 94 is closed, OR/NOR gate 144 will be without control input from any source whenever the piston 24 is arrested, normally at each end of its stroke. At this instant, gate 144 will produce a fluidic output at its outlet port $O_2$ and, after a delay determined by restrictor 150 and time delay accumulator 152, will produce a fluidic pulse at outlet $O_1$ of one-shot multivibrator 156, the duration of this pulse being dependent only upon the internal parameters of the device 156.

The outlet port $O_1$ of one-shot multivibrator 156 is connected to a control input line 160 of a bistable fluidic flip-flop 162 provided with a delayed feedback arrangement so as to function as a one-shot multivibrator. More particularly, device 162 exhibits the property that when a fluidic pulse is applied to its control input 160, the jet stream thereof is moved to a position for which it communicates with outlet port $O_1$, and it remains in this condition even after the input disappears until such time as a fluidic input on control line 164 occurs to return it to its original state for which output appears at outlet $O_2$, in which latter state it persists even after the control signal on line 164 disappears. Accordingly, when a pulse from one-shot multivibrator 156 occurs, device 162 is switched to produce an output on its output line 166; a portion of this output is fed back through the time delay accumulator 170 to control input 164, so that after this brief time delay, device 162 is reset and an output appears on line 168 thereof, a condition which then persists until the next pulse occurs from one-shot multivibrator 156. A principal purpose of device 162 in this specific embodiment is to provide a greater duration of pulse on line 166 that is obtained at the output of the one-shot multivibrator 156. Thus with certain commercial components the fluidic binary counter device 174 next to be described requires that its inputs be switched for certain minimum times, such as 20 milliseconds for example, and at least certain types of one-shot multivibrator devices commercially available produce only about a 10 milliseconds output pulse. By appropriate choice of the delay provided by time-delay accumulator 170, the time during which a fluidic pulse appears on line 166 may be increased to, for example, 20 milliseconds as desired for reliable operation of binary counter 174. Thus it would be possible to replace fluidic deviced 156 and 162 by a one-shot multivibrator having a sufficiently long switched time to operate the corresponding binary counter 174.

Binary counter 174 exhibits an output having two alternate states, one in which outlet port $0_1$ is supplied with fluid pressure to operate pilot valve 60 and the other outlet $0_2$ is deactuated, and another state in which outlet $0_2$ is supplied with fluidic pressure to operate pilot valve 62 while outlet $0_1$ is deactuated. Device 174 has one control input line $C_1$ connected to the outlet of valve 94, so that when valve 94 is opened to arrest operation of piston 24, the fluidic stream is thereby also applied to control input $C_1$ of device 174; this sets the latter device so that its output is from port $0_1$, thus holding pilot valve 60 in the condition for which it supplies cylinder air to cylinder port 54 and holds the piston in its retracted positon during "parking" of the piston. During normal operation, of course, valve 94 is closed, and there is no fluidic input to $C_1$ of device 174 so that it is free to change state.

Thus, during normal operation, device 174 switches from one of its two states to the other each time control input $C_3$ is supplied with a fluidic stream and control input $C_4$ is not. Accordingly, each time flip-flop multivibrator 162 goes through one cycle of its operation, two-state binary counter 174 will switch from one of its states to the other and remain there until the next cycle of operation of flip-flop multivibrator 162.

In the overall operation of the system then, assume first that reciprocation of the piston 24 has been arrested by turning valve 94 to the off position for which the valve is open. Under these conditions, the fluidic stream applied to $C_1$ of binary counter 174 maintains the latter device in the state for which it produces output from its outlet $0_1$, operates pilot valve 60, and causes cylinder air to be supplied to the left-hand port 54 of the cylinder device 26, thereby holding the piston in its right-hand or fully-retracted position while it is "parked". When the system is turned on by manually closing valve 94, gate 144 will revert to its $0_2$ output condition, and after a predetermined delay will operate one-shot multivibrator 156 and modified flip-flop 162 so as to change the state of the binary counter 174, remove fluidic pressure from the pilot connection 72 of pilot device 60, and apply it instead to the pilot connection 74 of pilot device 62, thereby connecting the left side of piston 24 to exhaust and the right side to cylinder air to drive it to its fully-advanced condition. As soon as this advancing motion begins, the exhaust stream from port 54 of cylinder device 26 is sensed by isolator amplifier 90 and OR/NOR gate 144, the latter device being thereby held so that its outlet $0_1$ is actuated and no pulse is generated or applied to the binary counter 174. When the piston has advanced fully and is arrested at its forward extreme position, the exhaust flow from port 54 terminates; actuator amplifier 90 is switched to its opposite condition for which it has zero output flow; OR/NOR gate 144 reverts to its $0_2$ outlet; after a predetermined delay the one-shots 156 and 162 produce a pulse at the $C_3$ input to the binary counter 174; and the latter device changes its state so that cylinder air is applied to the left end of the piston 24 and the other side is exhausted through pilot valve 62 while the piston moves to the right. When the piston reaches its extreme right-hand position, this cycle repeats itself, with a dwell time at each end of the stroke determined by the time constant of restrictor 150 and time delay accumulator 152.

It is noted that should the piston 24 by mechanically arrested before it reaches an extreme of its stroke, as might occur for example should one of the closures become cocked so that the piston cannot enter the opening in the closure but instead strikes the sidewall of the closure the system will not become jammed in this position with the piston permanently arrested; instead, when the piston is thus stopped in its advancing motion, the system will function as described above so that, after the same predetermined dwell time, the piston motion reverses and the piston retracts so that the faultily positioned closure can then be moved on out of the measuring station, for example. When it is desired again to stop the reciprocating action, the on/off valve is turned to its open position to prevent further actuation of the binary device 174, and to set the state of the latter device to its "park" position as described previously.

It is also noted that the output of isolator amplifier 90 is also connected through restrictor **97*a* to a line 97 extending to the logic and control circuit, so that a fluidic flow in line 97 indicates output from device 90 and thereby provides information that the piston 24 is moving to the left; similarly, the outlet 138 of isolator amplifier 92 is connected through restrictor 98*a* to fluidic line 98 leading to the logic and control circuit, to provide an indication of when piston 24 is moving to the right. A fluidic line 99 connecting the $0_1$ outlet of gate 144 to the logic and control circuitry provides an indication of when the reciprocation of piston 24 has been arrested, as by turning the on/off control to the off position. Line 100 extending from the logic and control circuitry to the control input $C_1$ of gate 144 permits remote automatic arresting of the piston reciprocation by supplying a fluidic flow to $C_1$ to hold the output of gate 144** in its $0_1$ condition.

It will therefore be appreciated that there has been provided a simple, convenient and reliable system employing a fluidic control arrangement for controlling the timing of reciprocation of a fluid-driven piston, so that the piston dwells in an arrested position each time its stroke is arrested and then reverses its motion, even if such arresting occurs prior to the extreme end of its stroke, with provision for controlledly varying the duration of the dwell time and for arresting reciprocation either manually or remotely; in addition, outputs indicative of the direction of the piston stroke at any given time, and of whether the piston is arrested, are provided. This is accomplished generally by sensing the termination of exhaust flow from the two sides of the piston and using this to control the timing of initiation of the return stroke of the piston.

While the invention has been described with particular reference to specific embodiments there of in the interest of complete definiteness, it will be understood that it may be embodied in a variety of forms diverse from those specifically shown and described, without departing from the spirit and scope of the invention as defined by the appended claims.

What is claimed is:

1. Apparatus for controlling the reciprocation of a piston in a cylinder chamber having a first port near one end thereof and a second port near the other end thereof, each said port being positioned beyond the cylinder wall portion sealed off by said piston when in its most extreme positions, said apparatus comprising:

first and second pilot valve means each having a cylinder connection, an exhaust connection, a cylinder-air supply connection, and a pilot control connection responsive to a change in fluidic pressure to switch said cylinder connection from communication with said cylinder-air connection to communication with said exhaust connection;

means connecting said cylinder connections of said first and second pilot valve means to said first and second ports respectively;

a source of cylinder-air connected to said cylinder-air supply connections of both of said first and second pilot valve means;

first fluidic means responsive to simultaneous occurrence of substantially zero exhaust flow from said exhaust connections of said first and second pilot valve means to switch its output from a first position to a second position;

second fluidic means having two output connections and two stable output states in one of which states the fluidic pressure at one of said two connections is high compared to that at the other of said two output connections and vice versa in the other of said two states;

means responsive to each occurrence of said second output position of said first fluidic means to reverse the state of said second two-state fluidic means; and means connecting said output connections of said second two-state fluidic means to respective pilot control connections of said first and second pilot valve means to switch said first and second pilot valve means alternately at times determined by the times of said simultaneous occurrences of substantially zero exhaust flow.

2. The apparatus of claim 1, comprising means for delaying each said reversal of state of said second two-state fluidic means by a predetermined amount with respect to the times of said simultaneous occurrences.

3. The apparatus of claim 2, comprising single control means for adjusting the duration of said delay.

* * * * *